US010436102B2

(12) United States Patent
Park et al.

(10) Patent No.: US 10,436,102 B2
(45) Date of Patent: Oct. 8, 2019

(54) COOLING SYSTEM FOR VEHICLES AND CONTROL METHOD THEREOF

(71) Applicants: HYUNDAI MOTOR COMPANY, Seoul (KR); KIA Motors Corporation, Seoul (KR)

(72) Inventors: Cheol Soo Park, Suwon-si (KR); Dong Suk Chae, Seoul (KR); Phil Gi Lee, Suwon-si (KR); Jun Sik Park, Seoul (KR); Jea Woong Yi, Uiwang-si (KR)

(73) Assignees: HYUNDAI MOTOR COMPANY, Seoul (KR); KIA Motors Corporation, Seoul (KR)

( * ) Notice: Subject to any disclaimer, the term of this patent is extended or adjusted under 35 U.S.C. 154(b) by 1 day.

(21) Appl. No.: 15/975,401

(22) Filed: May 9, 2018

(65) Prior Publication Data

US 2019/0136743 A1 May 9, 2019

(30) Foreign Application Priority Data

Nov. 7, 2017 (KR) ..... 10-2017-0147211

(51) Int. Cl.

| | |
|---|---|
| ***F01P 7/14*** | (2006.01) |
| ***F01P 7/16*** | (2006.01) |
| *F02M 26/28* | (2016.01) |

(52) U.S. Cl.

CPC ..... *F01P 7/165* (2013.01); *F01P 7/14* (2013.01); *F01P 2007/146* (2013.01); *F01P 2025/30* (2013.01); *F01P 2025/32* (2013.01); *F02M 26/28* (2016.02)

(58) Field of Classification Search

CPC ..... F01P 7/14; F01P 7/16; F01P 7/165; F01P 2025/30; F01P 2025/32; F02M 26/28

See application file for complete search history.

(56) References Cited

FOREIGN PATENT DOCUMENTS

JP 2004137981 A 5/2004

*Primary Examiner* — Eric S Ruppert

(74) *Attorney, Agent, or Firm* — McDonnell Boehnen Hulbert & Berghoff LLP

(57) ABSTRACT

A cooling system for vehicles and a control method thereof improves indoor heating performance and fuel efficiency by controlling a flow rate of a coolant passing through a heater core together with an EGR cooler. A coolant having an increased temperature is first supplied to the heater core side through a flow stagnancy control to rapidly increase the temperature of the coolant flowing in the heater core, thereby improving heating performance. A warm-up feature is improved through an exhaust heat recovery function by a heat exchange between the exhaust gas and the coolant in the EGR cooler, thereby improving efficiency of fuel.

9 Claims, 6 Drawing Sheets

[FIG. 1]
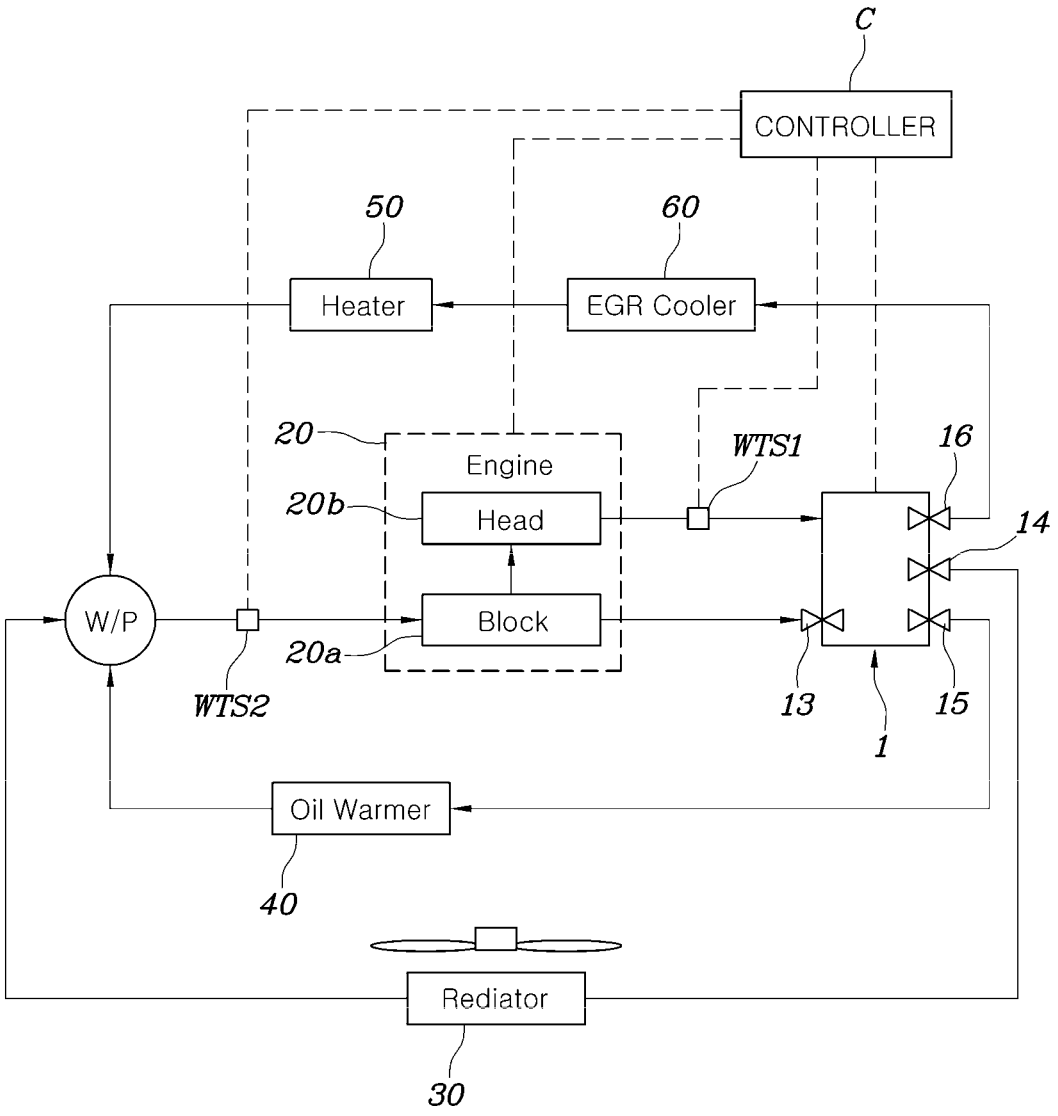

[FIG.2]
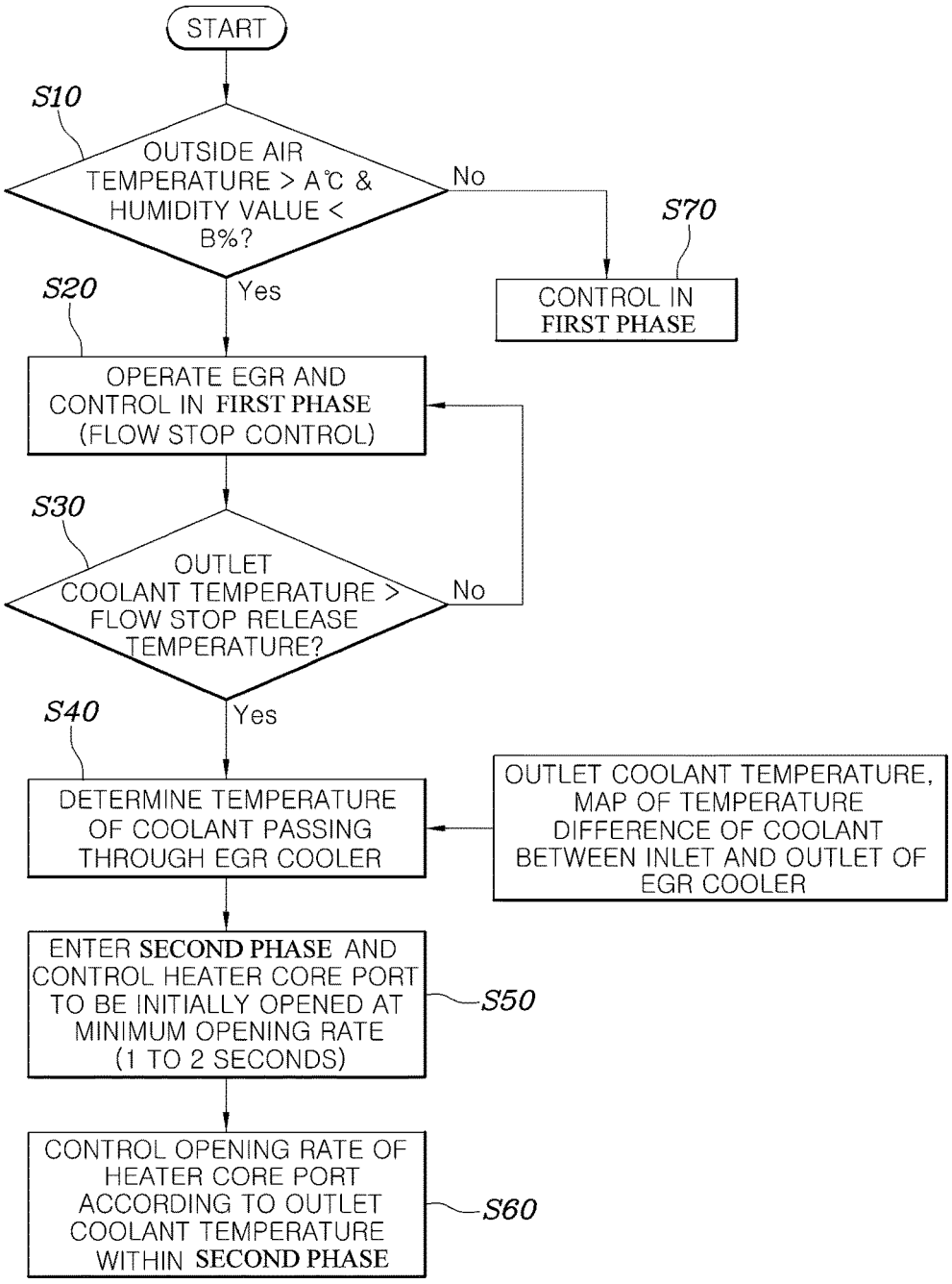

[FIG.3]
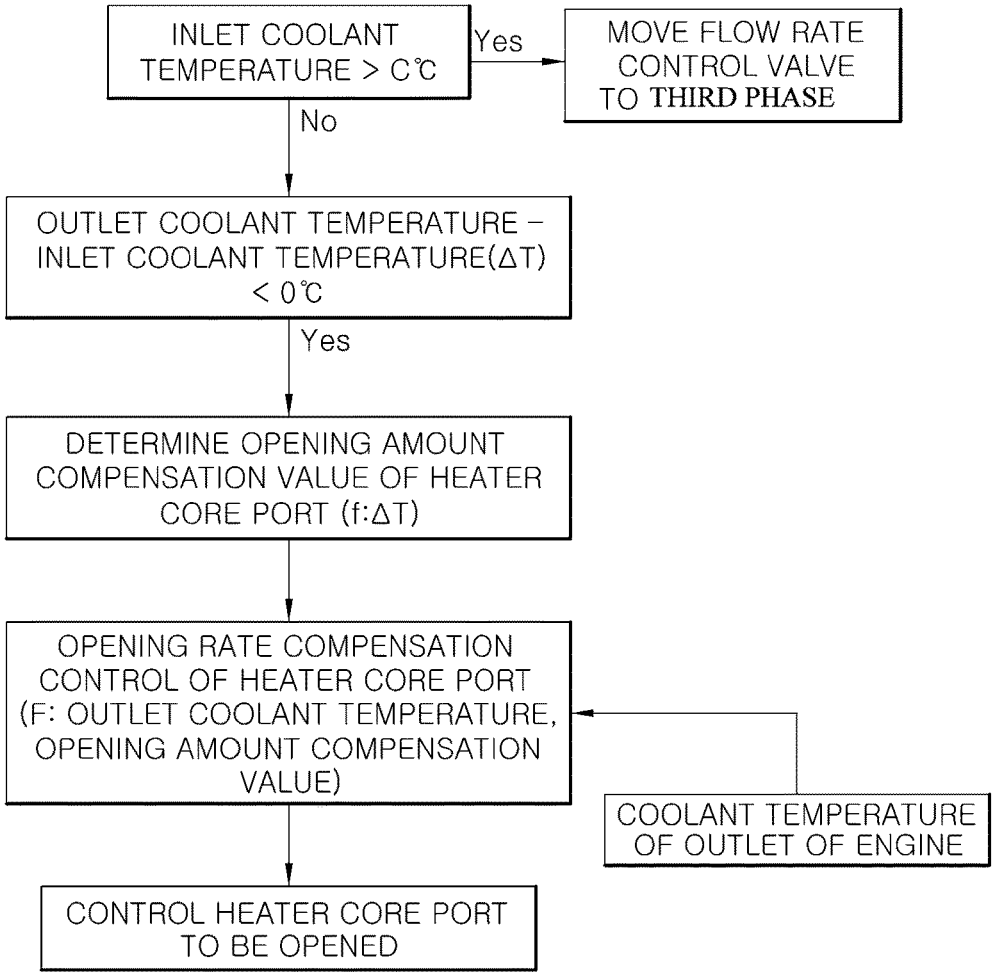

[FIG.4]
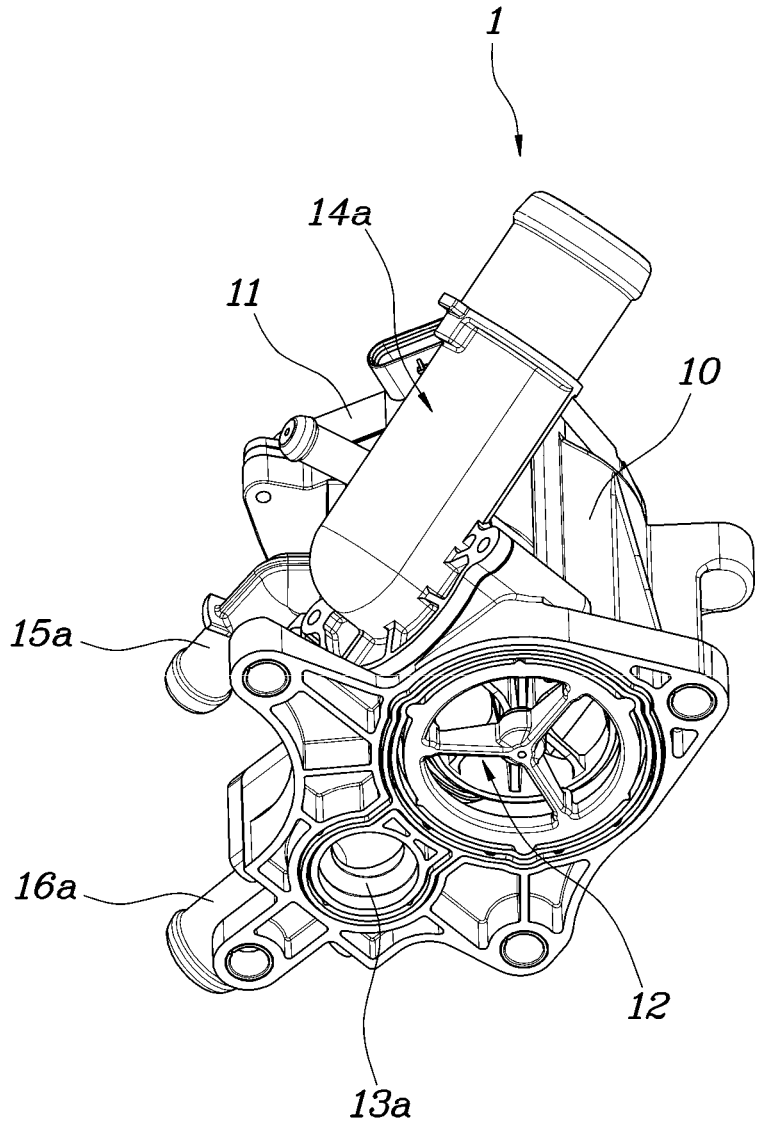

[FIG.5]
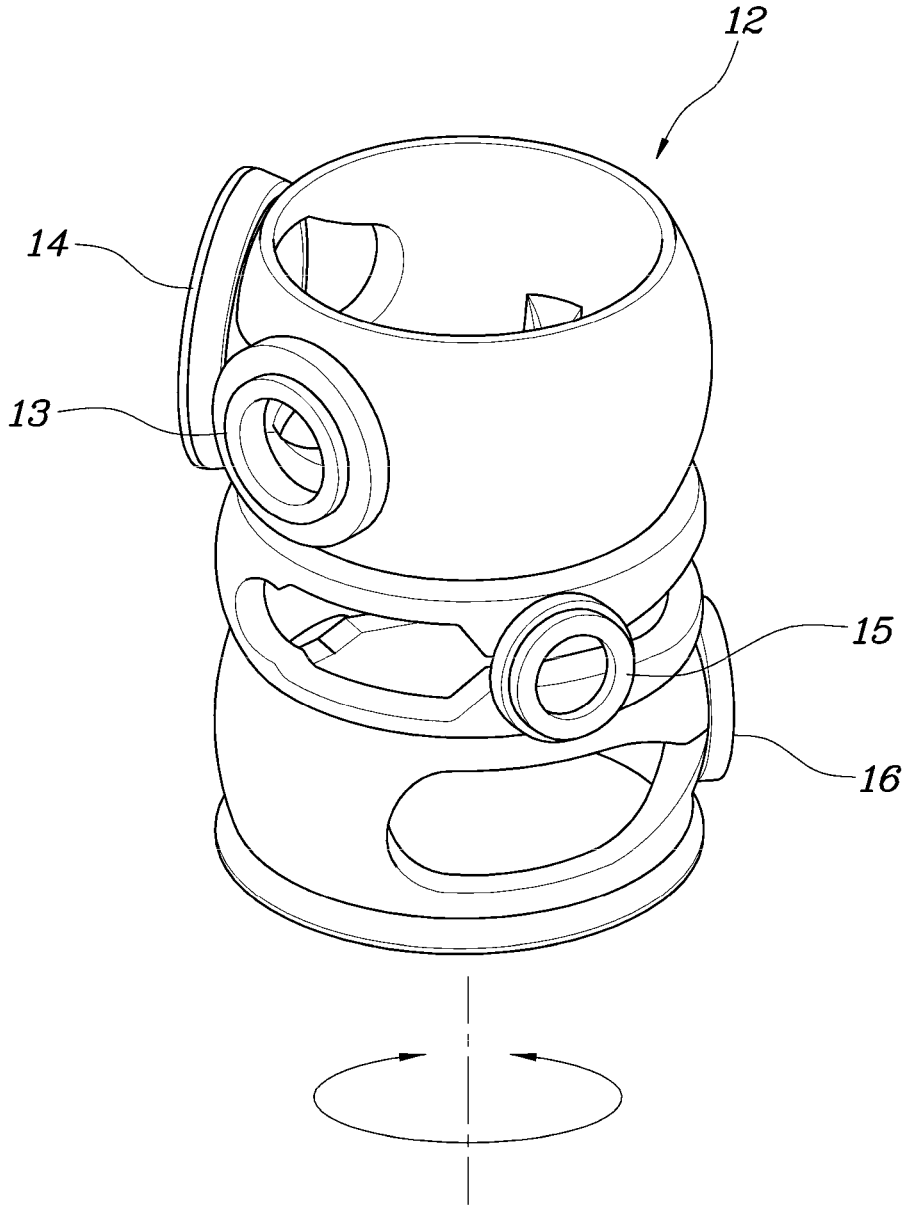

[FIG. 6]
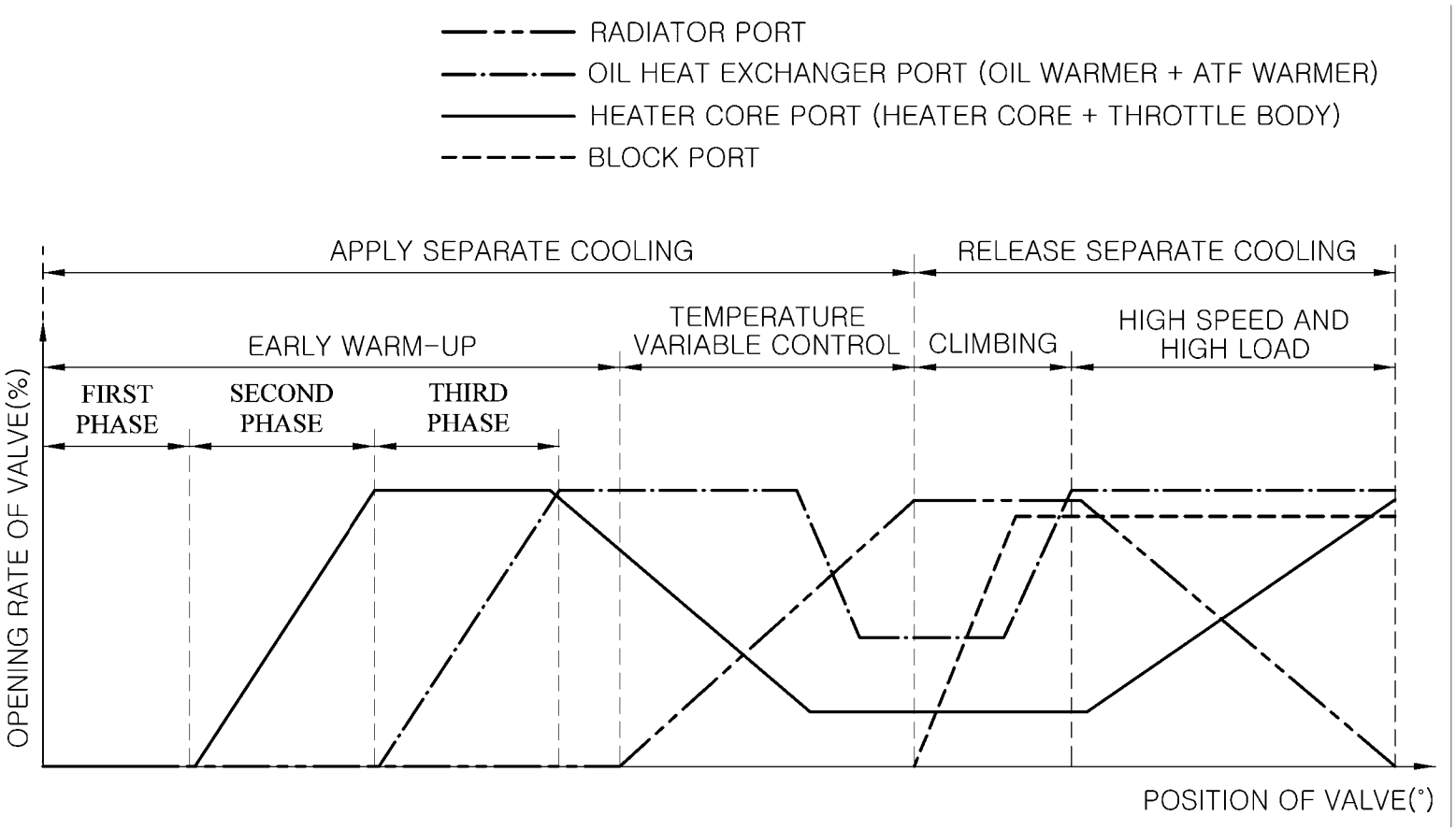

COOLING SYSTEM FOR VEHICLES AND CONTROL METHOD THEREOF

CROSS REFERENCE TO RELATED APPLICATION

This application claims the benefit of Korean Patent Application No. 10-2017-0147211 filed on Nov. 7, 2017, entitled "Cooling System for Vehicles and Control Method Thereof", which is hereby incorporated by reference in its entirety into this application.

BACKGROUND OF THE DISCLOSURE

1. Technical Field

The present disclosure relates to a cooling system for vehicles capable of improving indoor heating performance and fuel efficiency by controlling a flow rate of coolant passing through a heater core together with an EGR cooler, and a control method thereof.

2. Description of the Related Art

A cooling system using a mechanical and wax-type thermostat measures a temperature of coolant using only one water temperature sensor at an outlet side of an engine, and determines and controls a use start temperature of an EGR cooler using the measured temperature of the coolant.

To this end, since the temperature of the coolant at the outlet of the engine needs to have the same temperature condition as the coolant which is actually introduced into the EGR cooler, a position of the EGR cooler is disposed to be close to the outlet side of the engine.

However, since the EGR cooler is restricted to a specific position, the arrangement of the EGR cooler as described above may degrade the ability to control other valves used to control the coolant.

The matters described as the related art have been provided only for assisting in the understanding for the background of the present disclosure and should not be considered as corresponding to the related art known to those skilled in the art.

SUMMARY OF THE DISCLOSURE

An object of the present disclosure is to provide a cooling system for vehicles capable of improving indoor heating performance of the vehicle by controlling a flow rate of coolant passing through a heater core together with an EGR cooler by a water temperature sensor and a flow rate control valve which are positioned at an inlet and an outlet of an engine and improving efficiency of fuel through a high-speed warm-up of the engine, and a control method thereof.

According to an exemplary embodiment of the present disclosure, there is provided a cooling system for vehicles including a flow rate control valve having a block port connected to a coolant outlet of a cylinder block of an engine, a radiator port connected to a radiator, an oil heat exchanger port connected to an oil heat exchanger, and a heater core port connected to a heater core and an EGR cooler, wherein in a predetermined first phase of an overall rotary operation of the flow rate control valve, the block port, the radiator port, the oil heat exchanger port, and the heater core port are all closed; in a predetermined second phase, only the heater core port is opened; and in a predetermined third phase, the oil heat exchanger port is opened in a state in which the heater core port is maximally opened.

An opening rate of the heater core port may exceed 0% at a boundary point between the first phase and the second phase so that the heater core port starts to be opened, and the opening rate of the heater core port may become 100% at a boundary point between the second phase and the third phase so that the heater core port is fully opened.

An opening rate of the oil heat exchanger port may exceed 0% at a boundary point between the second phase and the third phase so that the oil heat exchanger port starts to be opened.

The opening rate of the heater core port in the second phase and the opening rate of the oil heat exchanger port in the third phase may be linearly increased according to a rotary operation of the flow rate control valve.

According to another exemplary embodiment of the present disclosure, there is provided a control method of a cooling system for vehicles including a flow rate control valve having a block port connected to a coolant outlet of a cylinder block of an engine, a radiator port connected to a radiator, an oil heat exchanger port connected to an oil heat exchanger, and a heater core port connected to a heater core and an EGR cooler, wherein an inlet water temperature sensor and an outlet water temperature sensor are each disposed at an inlet side and an outlet side of the engine and the flow rate control valve is disposed at a rear end of the outlet water temperature sensor, the control method including: a flow stop operation of performing, by a controller, a flow stop control of a coolant by controlling the EGR cooler to be operated and closing the ports of the flow rate control valve, when an outside air temperature exceeds a set temperature at a time of starting-up the vehicle; a coolant temperature determination operation of determining, by the controller, a temperature of the coolant passing through the EGR cooler using a relationship between an outlet coolant temperature and map data of a temperature difference of the inlet and the outlet of the EGR cooler for a flow rate of the coolant passing through the EGR cooler when the outlet coolant temperature measured by the outlet water temperature sensor exceeds a flow stop release set temperature; and an open control operation of controlling the heater core port on which the EGR cooler is disposed to be opened so that the temperature of the coolant passing through the EGR cooler does not exceed a boiling coolant temperature which is set to prevent overheating of the EGR cooler.

In the flow stop operation, a humidity value may be further determined.

In an initial phase of the open control operation, the flow rate control valve may be controlled to open the heater core port at a minimum opening rate for a predetermined time in order to finely control the flow rate of the coolant supplied to the EGR cooler.

After the initial phase of the open control operation, an opening rate of the heater core port may be determined according to the outlet coolant temperature to control the flow rate control valve.

The open control operation may include an opening amount compensation value determination operation of determining an opening amount compensation value of the heater core port as a function of a difference value of an inlet coolant temperature and an outlet coolant temperature, when the inlet coolant temperature measured by the inlet water temperature sensor after the initial phase is a predetermined temperature or less and is higher than the outlet coolant temperature measured by the outlet water temperature sensor; and a compensation control operation of controlling the heater core port to be opened by providing feedback on the opening amount compensation value for the outlet coolant temperature to compensate for the opening rate of the heater core port.

BRIEF DESCRIPTION OF THE DRAWINGS

FIG. 1 is a view illustrating a configuration in which an EGR cooler is disposed in a flow path in which a heater core is disposed, in a cooling system for vehicles according to the present disclosure;

FIGS. 2 and 3 are views illustrating a control flow of the cooling system for vehicles according to the present disclosure;

FIG. 4 is a perspective view illustrating a flow rate control valve which is applicable to the present disclosure;

FIG. 5 is a view illustrating a shape of a valve body embedded in the flow rate control valve of FIG. 4, and a structure in which the respective ports are disposed; and FIG. 6 is a view illustrating a diagram illustrating a change of an opening rate of the respective ports according to a change of an operation angle of the flow rate control valve according to the present disclosure.

DESCRIPTION OF THE EXEMPLARY EMBODIMENTS

Exemplary embodiments of the present disclosure will be described in detail with reference to the accompanying drawings.

FIG. 1 is a view illustrating a configuration of a cooling system for vehicles according to the present disclosure. An inlet water temperature sensor WTS2 is installed on a flow path of an inlet side of an engine and an outlet water temperature sensor WTS1 is installed on a flow path of an outlet side of the engine.

In addition, a flow rate control valve 1 is installed at a rear end of the outlet water temperature sensor WTS1. Such a flow rate control valve 1 may variably control four ports at one time by an operation of only a valve body included in the valve.

For example, the flow rate control valve 1 is provided with at least three or more discharge ports. The respective discharge ports may be each connected to flow paths on which a radiator 30, an oil heat exchanger such as oil warmer 40, or the like, and a heater core 50 are disposed, thereby adjusting a flow rate of coolant discharged from these flow paths.

In particular, the EGR cooler 60 may be disposed on the flow path on which the heater core 50 is disposed in between the flow rate control valve 1 and a water pump. Although not illustrated in the drawings, the EGR cooler 60 may also be disposed on the flow path on which the oil warmer 40 is disposed, as needed.

In addition, a coolant outlet of a cylinder block 20*a* and a coolant outlet of a cylinder head 20*b* of the engine 20 are each independently connected to the flow rate control valve 1. In addition, the flow rate control valve 1 is provided with a block port 13, and the block port 13 is connected to the coolant outlet of the cylinder block 20*a*, thereby making it possible to adjust a flow rate of the coolant introduced into the flow rate control valve 1.

Further, FIGS. 4 and 5 are views illustrating the flow rate control valve 1 which is applicable to the present disclosure. The flow rate control valve 1 may be configured to include a valve housing 10, a driving part 11, and a valve body 12.

Referring to the illustrated drawings, the valve housing 10 may include a block port 13, a radiator port 14, an oil heat exchanger port 15, and a heater core port 16 so that the coolant discharged from the engine 20 is introduced into the valve housing 10 and the introduced coolant is discharged.

For example, the block port 13 may be connected to the coolant outlet of the cylinder block 20*a*, the radiator port 14 may be connected to the flow path on which the radiator 30 is disposed, the oil heat exchanger port 15 may be connected to the flow path on which the oil warmer 40 is disposed, and the heater core port 16 may be connected to the flow path on which the heater core 50 is disposed.

For reference, reference numeral 13*a* in FIG. 4 illustrates a pipe path connected to the block port 13, reference numeral 14*a* illustrates a pipe path connected to the radiator port 14, reference numeral 15*a* illustrates a pipe path connected to the oil heat exchanger port 15, and reference numeral 16*a* illustrates a pipe path connected to the heater core port 16.

The driving part 11 is mounted on the valve housing 10 to provide torque, and may be preferably a motor.

The valve body 12 is included inside the valve housing 10, and receives the torque from the driving part 11 to be rotated within a range of a predetermined angle.

Such a valve body 12 is formed in a cylinder shape having a hallowed inner portion, and may be selectively communicated with the block port 13, the radiator port 14, and the oil heat exchanger port 15 as a rotary angle of the valve body 12 is changed.

That is, as the valve body 12 is rotated, the amount of opening of the respective ports is adjusted and a flow rate of the coolant may be controlled.

However, a lower portion of the valve body 12 is formed in an opened shape and is connected to the outlet of the cylinder head 20*b*, thereby making it possible to introduce the coolant discharged from the cylinder head 20*b* into the valve body 12.

In particular, FIG. 6 is a diagram illustrating a change of an opening rate of the respective ports according to a change of an operation angle of the flow rate control valve 1. The X axis of the diagram represents a total of rotary angle (a section between the leftmost end and the rightmost end) of the valve body, and the Y axis represents the opening rate of the respective ports.

That is, since the total of the rotary angle of the flow rate control valve 1 may be determined within a predetermined angle range, when the operation angle is changed within the total of the rotary angle according to a driving state of the vehicle, the amount of opening of the radiator port 14, the oil heat exchanger port 15, the heater core port 16, and the block port 13 is changed according to the changed angle.

In addition, separating and cooling the cylinder head 20*b* and the cylinder block 20*a* according to an opening or closing of the block port 13 by the operation of the flow rate control valve 1 may be applied or released. The amount of opening of the radiator port 14, the oil heat exchanger port 15, and the heater core port 16 is together controlled. Thus, it is possible to variably control the four ports at one time only by the operation of the flow rate control valve 1.

Therefore, the cooling system for vehicles according to the present disclosure will be described in detail with reference to FIG. 1 together with the diagram illustrated in FIG. 6. All of the block port 13, the radiator port 14, the oil heat exchanger port 15, and the heater core port 16 may be formed to be closed in a predetermined first phase of the flow rate control valve 1.

That is, the first phase may be a phase which is firstly positioned from the left most portion of FIG. 6. For example, when the engine 50 starts-up, the coolant is controlled to be flow-stagnated inside the engine 50 by closing all of the ports, thereby eliminating loss of heat energy to the outside in order to implement a fast warm-up of the entire engine. This contributes to an improvement of efficiency of fuel and an improvement of emissions of the engine accordingly.

Further, only the heater core port 16 may be opened in a predetermined second phase toward the other direction from the first phase.

That is, as seen in FIG. 6, the second phase may be a secondly positioned phase bounding on the first phase. For example, the opening rate of the heater core port 16 may exceed 0% at a boundary point between the first phase and the second phase so that the heater core port starts to be opened.

Preferably, the opening rate of the heater core port 16 in the second phase may be linearly increased according to the change of the rotary operation angle of the flow rate control valve 1.

In addition, the oil heat exchanger port 15 may be opened in a state in which the heater core port 16 is maximally opened in a predetermined third phase toward the other direction from the second phase.

That is, as seen in FIG. 6, the third phase may be a thirdly positioned phase bounding on the second phase. For example, the opening rate of the heater core port 16 may become 100% at a boundary point between the second phase and the third phase so that the heater core port 16 is fully opened.

In this case, the opening rate of the heater core port 16 in the third phase may maintain 100% to maintain the fully opened state.

In addition, the opening rate of the oil heat exchanger port 15 may exceed 0% at a boundary point between the second phase and the third phase so that the oil heat exchanger port 15 starts to be opened. Preferably, the opening rate of the oil heat exchanger port 15 in the third phase may be linearly increased according to the change of the rotary operation angle of the flow rate control valve 1.

In this case, the opening rate of the oil heat exchanger port 15 in the third phase may be increased up to 100% so that the oil heat exchanger port 15 is fully opened, or may be increased up to a predetermined opening rate which is less than 100% so that a portion of the oil heat exchanger port 15 is opened.

That is, as seen in FIG. 6, the first phase is a phase in which a flow of the coolant is stagnated, which is followed by the second phase in which the heater core port 16 is opened after the first phase, and then is followed by the third phase in which the oil heat exchanger port 15 is opened after the heater core port 16 is fully opened.

In the case of a cold weather region, a differentiated opening strategy of the flow rate control valve is required to maximize indoor heating performance of the vehicle.

According to the present disclosure, the temperature of the heater core is rapidly increased using heat energy generated from the engine by firstly supplying the coolant having the increased temperature through a flow stagnancy control and heat radiation of the EGR cooler to the heater core side, thereby making it possible to increase the heating performance of the vehicle.

Meanwhile, a method for controlling the cooling system including the flow rate control valve 1 having the above-mentioned configuration may include a flow stop operation, a coolant temperature determination operation, and an open control operation.

Referring to FIGS. 1, 2 and 6, in the flow stop operation, in a case in which an outside air temperature exceeds a set temperature when the vehicle starts-up, the controller C may perform the flow stop control of the coolant by controlling the EGR to be operated and closing the ports of the flow rate control valve 1.

That is, the flow of the coolant may be stopped by operating the flow rate control valve 1 within the first phase to close all of the ports of the flow rate control valve 1.

Further, in the flow stop operation, when a humidity sensor is provided, a humidity value together with the outside air temperature may be further determined.

In addition, in the coolant temperature determination, in a case in which an outlet coolant temperature measured by an outlet water temperature sensor WTS1 exceeds a flow stop release set temperature, the controller C may determine a temperature of the coolant passing through the EGR cooler 60 using a relationship between the outlet coolant temperature and map data of a temperature difference of the inlet and the outlet of the EGR cooler for the flow rate of the coolant passing through the EGR cooler 60.

In addition, in the open control operation, the heater core port 16 on which the EGR cooler 60 is disposed may be controlled to be opened so that the temperature of the coolant passing through the EGR cooler 60 does not exceed a boiling coolant temperature which is set to prevent overheating of the EGR cooler.

In this case, in an initial phase of the open control operation, in order to finely control the flow rate of the coolant supplied to the EGR cooler 60, the flow rate control valve 1 may be controlled so that the heater core port 16 is opened at a minimum opening rate for a predetermined time.

In addition, after the initial phase of the open control operation, the opening rate of the heater core port 16 is determined according to the outlet coolant temperature, thereby making it possible to control the flow rate control valve 1.

That is, at the time of an initial start-up of the engine, whether or not the flow stop control is performed may be determined based on the outlet coolant temperature, and particularly, in order to use the EGR, when the outside air temperature exceeds a predetermined temperature and the humidity sensor is provided, a condition that the humidity value is less than a predetermined humidity is required (S10).

On the contrary, in a case in which the outside air temperature is the predetermined temperature or less, or the humidity value is the predetermined humidity or more, condensate water is generated in an intake manifold. When the condensate water is generated in the EGR cooler 60, since it may cause corrosion of a cooler tube or a pin and may cause damage to the engine, only the flow stop control is performed without using the EGR (S70).

As such, in the case in which the outside air temperature exceeds the predetermined temperature, the flow stop of the engine is maintained by operating the flow rate control valve 1 within the first phase (S20). It is then determined whether or not the outlet coolant temperature measured at the outlet of the engine reaches a predetermined temperature (a flow stagnancy release reference temperature) (S30). If it is determined that the outlet coolant temperature reaches the predetermined temperature, the temperature of the coolant passing through the EGR cooler is determined using engine speed and torque, a flow rate of the coolant passing through the EGR cooler 60, data of a temperature difference between the inlet and the outlet of the EGR cooler 60, and the outlet coolant temperature (S40).

In addition, the control is performed to supply the coolant to the EGR cooler 60 by operating the flow rate control valve 1 to enter the second phase (S50). In this case, the flow rate of the coolant supplied to the EGR cooler 60 is finely controlled by calculating the opening amount of the heater core port 16 so that the coolant temperature determined in step S40 does not exceed a predetermined boiling coolant temperature and may be maximally and rapidly increased.

Here, in the case of the configuration of the cooling system according to the present disclosure, since the EGR cooler 60 is positioned at the rear end of the flow rate control valve 1, the outlet coolant temperature measured by the outlet water temperature sensor WTS1 disposed at the outlet of the engine may be represented by the temperature of the coolant supplied to the EGR cooler 60. Accordingly, the outlet coolant temperature may be used to control the flow rate of the coolant supplied to the EGR cooler 60.

For example, in a case in which the temperature difference of the inlet and the outlet of the EGR cooler 60 is 6° C. and the outlet coolant temperature (the flow stop release temperature) at the outlet of the engine is 70° C. in a condition that the EGR cooler 60 is opened by 100%, if the flow rate of the coolant passing through the EGR cooler 60 is 25%, as compared to the state in which the EGR cooler 60 is fully opened, the temperature difference of the inlet and the outlet of the EGR cooler 60 may become 24° C., and the coolant temperature at the outlet of the EGR cooler 60 may be calculated as 94° C. (70° C.+24° C.) accordingly.

In this way, the opening rate of the heater core port 16 is adjusted within a range in which the coolant temperature does not exceed the predetermined boiling coolant temperature and the flow rate of the coolant supplied to the EGR cooler 60 is controlled.

Further, in step S50, in order to give spare time in which the coolant warmed-up at the outlet of the engine enters the EGR cooler 60, the heater core port 16 is opened by a set minimum opening amount for about 1 to 2 seconds. Also, the warm-up is performed by gradually increasing the opening amount of the heater core port 16 according to the outlet coolant temperature in addition to the minimum opening amount (S60).

Further, the open control operation according to the present disclosure may further include an opening amount compensation value determination operation and a compensation control operation.

Referring to FIG. 3, in the opening amount compensation value determination operation, when the inlet coolant temperature measured by the inlet water temperature sensor WTS2 after the initial phase of the open control operation is a predetermined temperature or less and is higher than the outlet coolant temperature measured by the outlet water temperature sensor WTS1, an opening amount compensation value of the heater core port 16 may be determined as a function of the difference value of the inlet coolant temperature and the outlet coolant temperature.

In addition, in the compensation control operation, the heater core port 16 may be controlled to be opened by providing feedback regarding the opening amount compensation value for the outlet coolant temperature to the opening rate of the heater core port 16 to compensate for the opening rate of the heater core port 16.

That is, when the opening amount of the heater core 15 is controlled in the second phase, in a case in which the inlet coolant temperature passing through the EGR cooler 60 and measured by the inlet water temperature sensor WTS2 is higher than the outlet coolant temperature, it may be determined that the heater core port 16 is scantly opened because of an unknown reason. In this case, the flow rate of the coolant of the EGR cooler 60 is increased by compensating the opening amount of the heater core port 16 using the inlet coolant temperature and providing feedback and increasing the opening amount of the heater core port 16 based on the compensated opening rate.

As such, according to the present disclosure, the flow rate control of the coolant supplied to the EGR cooler 60 may be optimally implemented by controlling the flow rate of the coolant supplied to the EGR cooler 60 according to the temperature of the outlet of the engine and providing feedback and compensating for the flow rate of the coolant supplied to the EGR cooler 60 based on the temperature of the inlet of the engine.

As described above, according to the exemplary embodiments of the present disclosure, the coolant having the increased temperature is firstly supplied to the heater core side through the flow stagnancy control, thereby making it possible to rapidly increase the temperature of the coolant flowing in the heater core using heat energy generated from the engine to improve the indoor heating performance. The warm-up feature is improved through the exhaust heat recovery function by the heat exchange between the exhaust gas and the coolant in the EGR cooler 60, thereby making it possible to advantageously reduce friction and heat loss and to improve the efficiency of fuel.

Meanwhile, although the specific examples of the present disclosure have been described above in detail, various modifications and alterations may be made without departing from the spirit and scope of the present disclosure.

What is claimed is:

1. A cooling system for vehicles including a flow rate control valve having a block port connected to a coolant outlet of a cylinder block of an engine, a radiator port connected to a radiator, an oil heat exchanger port connected to an oil heat exchanger, and a heater core port connected to a heater core and an EGR cooler, wherein:

in a predetermined first phase of an overall rotary operation of the flow rate control valve, the block port, the radiator port, the oil heat exchanger port, and the heater core port are all closed;

in a predetermined second phase, only the heater core port is opened; and in a predetermined third phase, the oil heat exchanger port is opened in a state in which the heater core port is maximally opened.

2. The cooling system for vehicles of claim 1, wherein an opening rate of the heater core port exceeds 0% at a boundary point between the first phase and the second phase so that the heater core port starts to be opened, and the opening rate of the heater core port becomes 100% at a boundary point between the second phase and the third phase so that the heater core port is fully opened.

3. The cooling system for vehicles of claim 2, wherein an opening rate of the oil heat exchanger port exceeds 0% at a boundary point between the second phase and the third phase so that the oil heat exchanger port starts to be opened.

4. The cooling system for vehicles of claim 3, wherein the opening rate of the heater core port in the second phase and the opening rate of the oil heat exchanger port in the third phase are linearly increased according to a rotary operation of the flow rate control valve.

5. A control method of a cooling system for vehicles including a flow rate control valve having a block port connected to a coolant outlet of a cylinder block of an engine, a radiator port connected to a radiator, an oil heat exchanger port connected to an oil heat exchanger, and a heater core port connected to a heater core and an EGR cooler, wherein an inlet water temperature sensor and an outlet water temperature sensor are each disposed at an inlet side and an outlet side of the engine and the flow rate control valve is disposed at a rear end of the outlet water temperature sensor, the control method comprising:

a flow stop operation of performing, by a controller, a flow stop control of a coolant by controlling the EGR cooler to be operated and closing the ports of the flow rate control valve, when an outside air temperature exceeds a set temperature at a time of starting-up the vehicle;

a coolant temperature determination operation of determining, by the controller, a temperature of the coolant passing through the EGR cooler using a relationship between an outlet coolant temperature and map data of a temperature difference of the inlet and the outlet of the EGR cooler for a flow rate of the coolant passing through the EGR cooler when the outlet coolant temperature measured by the outlet water temperature sensor exceeds a flow stop release set temperature; and an open control operation of controlling the heater core port on which the EGR cooler is disposed to be opened so that the temperature of the coolant passing through the EGR cooler does not exceed a boiling coolant temperature which is set to prevent overheating of the EGR cooler.

6. The control method of claim 5, wherein in the flow stop operation, a humidity value is further determined.

7. The control method of claim 5, wherein in an initial phase of the open control operation, the flow rate control valve is controlled to open the heater core port at a minimum opening rate for a predetermined time in order to finely control the flow rate of the coolant supplied to the EGR cooler.

8. The control method of claim 7, wherein after the initial phase of the open control operation, an opening rate of the heater core port is determined according to the outlet coolant temperature to control the flow rate control valve.

9. The control method of claim 7, wherein the open control operation includes:

an opening amount compensation value determination operation of determining an opening amount compensation value of the heater core port as a function of a difference value of an inlet coolant temperature and an outlet coolant temperature, when the inlet coolant temperature measured by the inlet water temperature sensor after the initial phase is a predetermined temperature or less and is higher than the outlet coolant temperature measured by the outlet water temperature sensor; and a compensation control operation of controlling the heater core port to be opened by providing feedback on the opening amount compensation value for the outlet coolant temperature to compensate for the opening rate of the heater core port.

* * * * *